United States Patent [19]

Cummins

[11] 3,994,247

[45] Nov. 30, 1976

[54] MATERIAL POSITIONING APPARATUS

[75] Inventor: Donald Cummins, Hopewell, Va.

[73] Assignee: AMF Incorporated, White Plains, N.Y.

[22] Filed: May 30, 1975

[21] Appl. No.: 582,468

[52] U.S. Cl. ..... 112/210

[51] Int. Cl.[2] ..... D05B 27/00

[58] Field of Search ..... 112/210, 203, 153, 121.11, 112/211; 226/17

[56] References Cited

UNITED STATES PATENTS

| | | | |
|---|---|---|---|
| 3,013,513 | 12/1961 | Judelson | 112/203 |
| 3,147,898 | 9/1964 | Huck | 226/17 |
| 3,794,230 | 2/1974 | Byran et al. | 112/153 X |
| 3,867,889 | 2/1975 | Conner, Jr. | 112/121.11 |

*Primary Examiner*—Werner H. Schroeder
*Assistant Examiner*—Peter Nerbun
*Attorney, Agent, or Firm*—George W. Price; Martin Smolowitz

[57] ABSTRACT

The apparatus for aligning two plys of limp material being fed into a work station employs a pair of bi-directional motor driven belts operating in electrical circuit relationship with closed loop servo control and a pair of photo-diodes with light source sensing beams employed in retro-reflective configuration for generation of a bi-polar signal in response to the movement of the belts. A pair of pressure plates mounted in proximity to said belts, provide a nip between the belts and the plates for material gripping. The belts being movable in response to dark/light bi-polar signals generated by the presence or absence of material at the center line of each of said photo-diodes and the closed loop servo control is actuated to govern the movement of said belts with respect to any deviation from said center lines.

A pair of rate detector wheels are disposed in the line of travel of said plys of material and are in electrical circuit relation with a digital position servo motor to permit adjustment of the relative opposing force of each of the pressure plates in response to information imparted by the rate detector wheels into a differential computer operating in subtract mode and acting upon said servo motor through a controller.

9 Claims, 5 Drawing Figures

MATERIAL POSITIONING APPARATUS

The present invention is directed to an apparatus employed in conjunction with a commercially available sewing machine head. More particularly, the present invention is directed to an apparatus for automatically aligning the working edges of at least two plys of material to be joined together. Also within the scope of the present invention are automatic means for aligning the length of at least two pieces of material while concurrently carrying out the aforementioned edge alignment.

Obviously, when sewing or in some way joining two pieces of material in a predefined fashion, it is desirable to maintain a select relationship between the plys being joined. For an example, where the edges of two plys of material such as for trouser lengths are to be joined, it is most desirable to have the material advance past the sewing station without being subject to move or deviation from a prescribed course of travel.

Furthermore, it is most advantageous to have the plys of material advancing in a continuous predetermined manner without the need for the operator to periodically stop the joining operation in order to align the material to be sewn. In this connection, normally an operator would first visually and physically align the forward section of the material to be joined and then place the positioned together plys of material into the sewing station. Once the sewing cycle is initiated, the operator must continuously guide the material while monitoring the proper alignment of the edges and length of material being worked upon.

The prior art has attempted to deal with this problem in a number of ways but in most instances, the means employed are cumbersome, expensive, difficult to maintain and require more than ordinary operator skill.

For an example, U.S. Pat. No. 3,182,619 discloses an edge alignment arrangement where the layers of material to be worked upon are held in place by metal guides which are attached to a rack and pinion and are operated by a reversible motor. The motor, in turn, moves in response to a signal from a pair of edge sensing devices. While this type of system does in some manner perform the edge alignment function, it necessitates a substantial amount of preparation prior to initiating the sewing cycle and in fact also introduces a multiplicity of working members which can, in turn, increase the amount of possible error in alignment.

Other prior art patents, such as U.S. Pat. No. 2,971,483 employ a pair of impaling points for controlling the edge movement of a layer of material.

Accordingly, it is the main object of the present invention to overcome the defects of the prior art.

Still another object of the present invention is to provide in a sewing system an apparatus for aligning the edges of material to be joined, as well as the lengths of such material.

Still another object of the present invention is to provide a relatively inexpensive, simple to manufacture and easily adjustable apparatus for sewing two pieces of material in a controlled fashion to thusly assure both length and edge alignment.

Still a further object of the present invention is to provide a means capable of controlling both the edge and length alignment of materials possessing different characteristics which are fed through a sewing station.

Still other objects of the present invention will be more readily understood with respect to the accompanying specification, claims and drawings.

The principal features of the present invention are directed to an apparatus for aligning two plys of limp material being fed into a work station including: a pair of bi-directional motor driven belts disposed in electrical circuit relationship with closed loop servo control means; a pair of photodiodes with light source sensing means employed in retro-reflective configuration for generation of a bi-polar signal responsive to the movement of said belts; a pair of pressure plates mounted in proximity to said belts, provided a nip therebetween for material gripping, as respective plys of material advance to said work station under the action of each of said belts, said belts being movable in response to dark/light bi-polar signals generated by the presence or absence of material at the center line of each of said photo-diodes with light source, whereby said closed loop servo control means is actuated to govern the movement of said belts with respect to any deviation from said center lines; and a pair of rate detector wheels disposed in the line of travel of said plys of material, for rotation in response to the movement of said material; said rate detector wheels and said pressure plates being in electrical circuit relation with a digital position servo motor means to thereby adjust the relative opposing force of each of said pressure plates in response to information imparted by said rate detector wheels into a differential computer operating in subtract mode and acting upon said servo motor means through a controller means.

Also within the scope of the invention is an alignment apparatus in combination with a sewing machine station having a presser foot and cooperative feed dogs for advancing an upper ply and a lower ply of material into sewing means for sewing said plys together, said alignment apparatus being forward of and disposed along the line of travel of said material plys for urging respective edge portions and lengths of said material plys into alignment with respect to one another, including: upper and lower motor driven rotatable gripping belts mounted on a support means for movement of each of said material plys above and below said support means; said support means being defined by a member having cnverging surfaces for separating said upper and lower plys of material as they advance; upper and lower material gripping means pivotally mounted in proximity to said gripping belts, provided with material contact surfaces to thereby form a nip with each of said upper and lower belt meams; upper and lower sensing means each being positioned in working relation to said upper and lower gripping belts, each of said sensing means being adapted to sense the absence of presence of respective plys of material at the center line thereof; control means in circuit relation with each of said sensing means and said belt means, for continuously governing the movement of each of said belts, responsive to signals imparted by the respective position of each of said plys of material; upper and lower rotary sensing means being pivotally mounted in support arms for position along the line of travel of said material plys, said rotary sensing means providing a signal means responsive to the longitudinal movement between each of said plys of material; passage means formed between a forward portion of said support means and each of said rotary sensing means for movement of material therethrough; and control means responsive to signal means imparted through the impingement of said rotary sensing means on said material, for restraining forward movement of said material plys in respect to each other, as a function of the relative restraining force of said upper and lower material gripping means.

Figure 3:
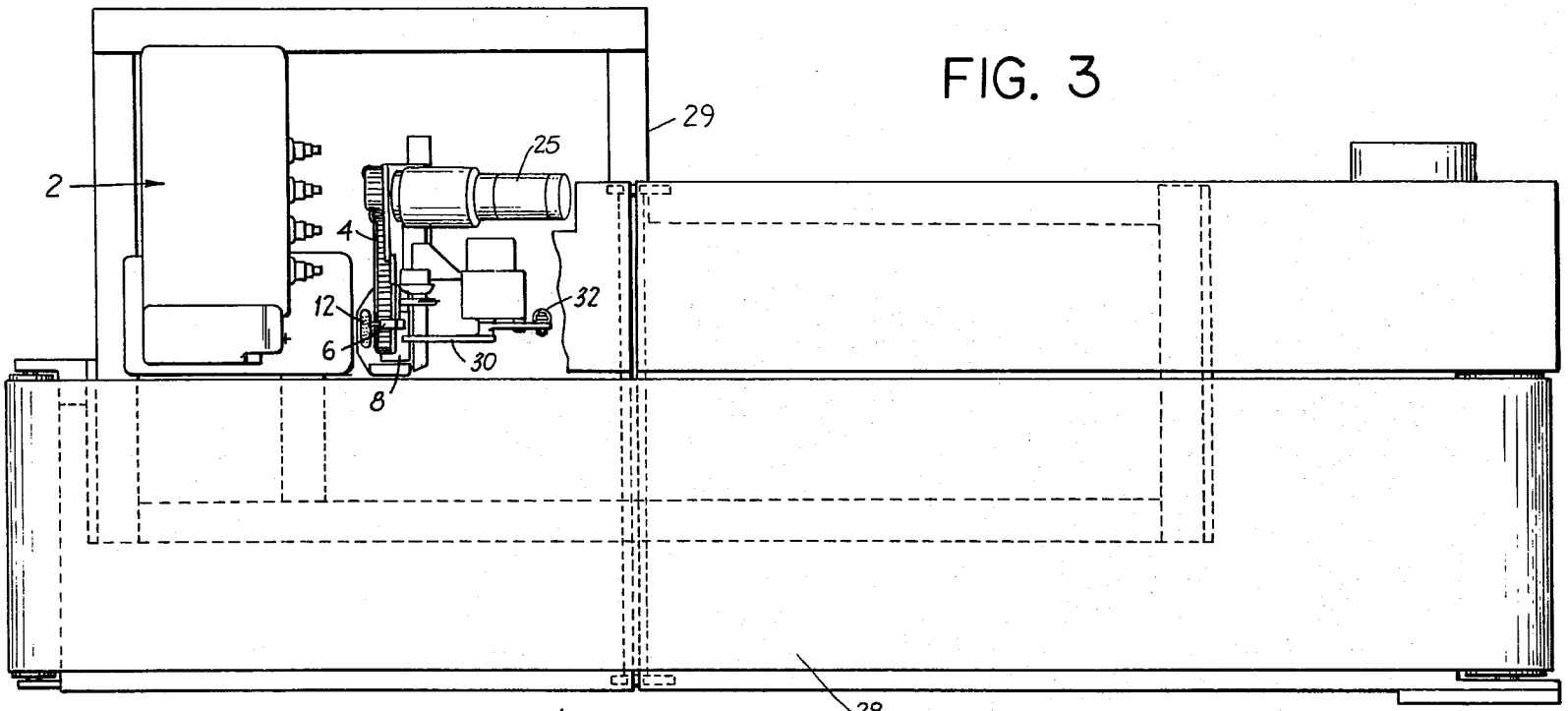
FIG. 3 is top view of the invention apparatus as employed at a sewing station.
Figure 4:
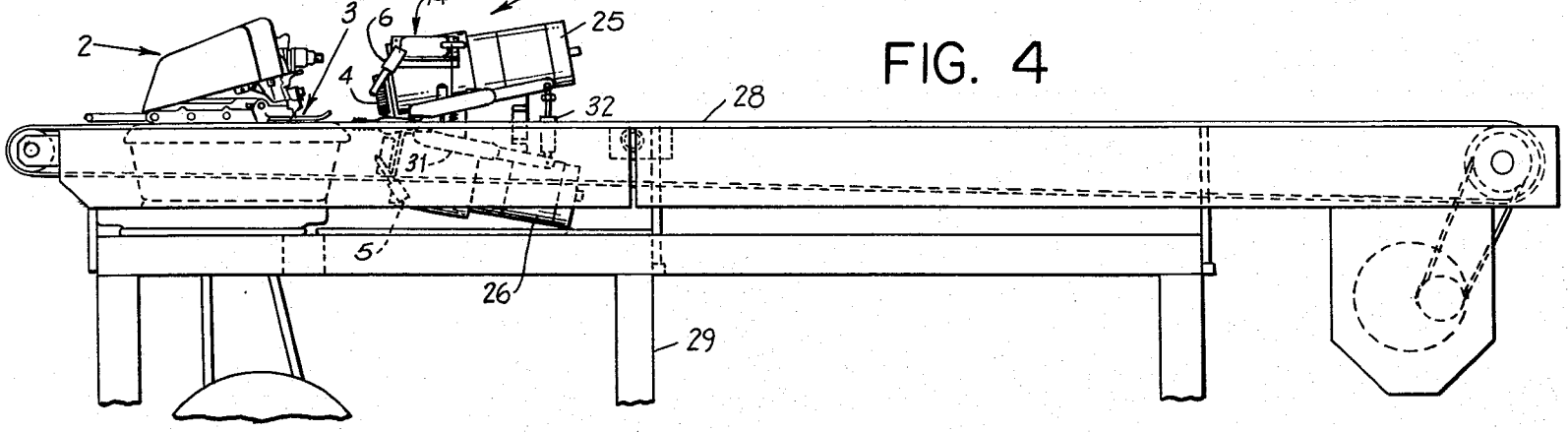
FIG. 4 is a partial profile view of FIG. 3.

As shown in FIGS. 3 and 4, the inventive device 1 as employed in an actual operating situation, works upon two pieces of limp material (not shown) which are to be fastened together by a seam as the material passes through a motor driven sewing apparatus 2. The sewing apparatus 2 is mounted in such a manner so as to receive the worked upon material after it has been aligned by the invention and is ready to proceed in the sewing cycle. The inventive device 1 is employed as an interface between the machine operator and the sewing apparatus 2.

Figure 5:
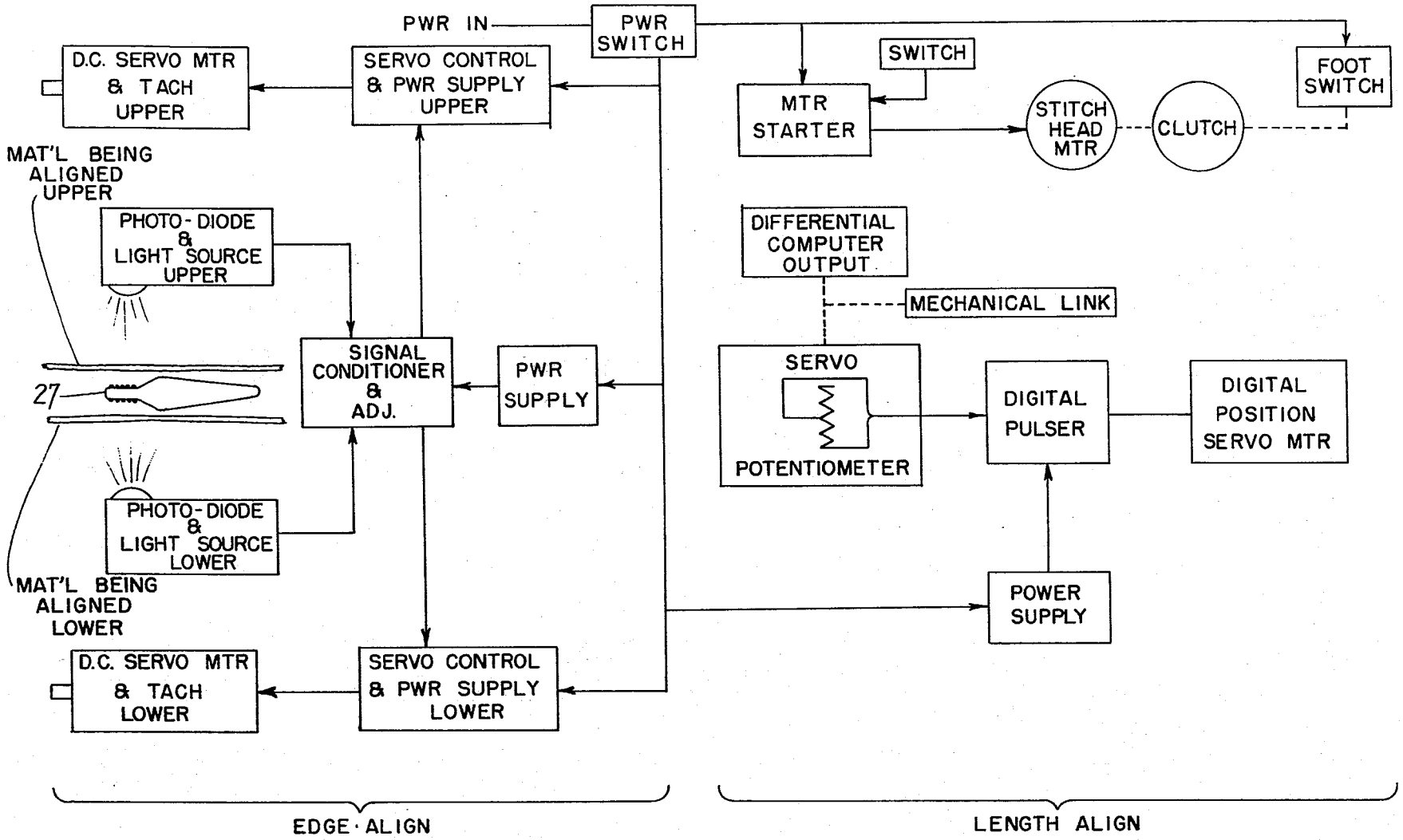
FIG. 5 is a composite block diagram of control circuitry used with the apparatus shown in FIGS. 1 and 2.

Both the inventive device 1 and the sewing apparatus 2 are positioned in proximity to a conventional material moving conveyor 28 disposed on a common frame 29. The conveyor 28 serves to support the bulk of the limp material pieces in concert with the linear speed of the feed dogs and processer foot 3. The inventive device can be actuated by a foot pedal (not shown) which serves to initiate the power to the sewing apparatus 2, conveyor 28 and inventive device 1. The movement of each bi-directional belt 4, 5 through motors 25, 26 is controlled by means of a conventional closed loop servo system (see FIG. 5) for each belt 4, 5 in which a bi-polar signal from a photo-diode with light source 6, 7 are employed in a retro-reflective configuration. In effect, the two pieces of limp material are each respectively inserted between each of the belts 4, 5 and associated pressure plates 8, 9 to thereby initiate alignment. Nominal spring pressure to plates 8, 9 is provided by a screw and spring arrangement 24. By adjusting the screw, the material gripping force may be increased or decreased, in order to take into account different material characteristics, such as, thickness, resilience, etc. The upper and lower belts 4, 5 each draws respective pieces of material to be sewn towards the center line of respective photo-diode with light source 6, 7. The dark/light bi-polar signals from the photo-diode with light source 6, 7 are fed back to respective servo-controls to cause null seeking on the center line of each of the photo-diode 6, 7 resulting in constant correction for any deviation from the center line, thus allowing correct alignment of the pieces of material to be sewn.

Figure 1:
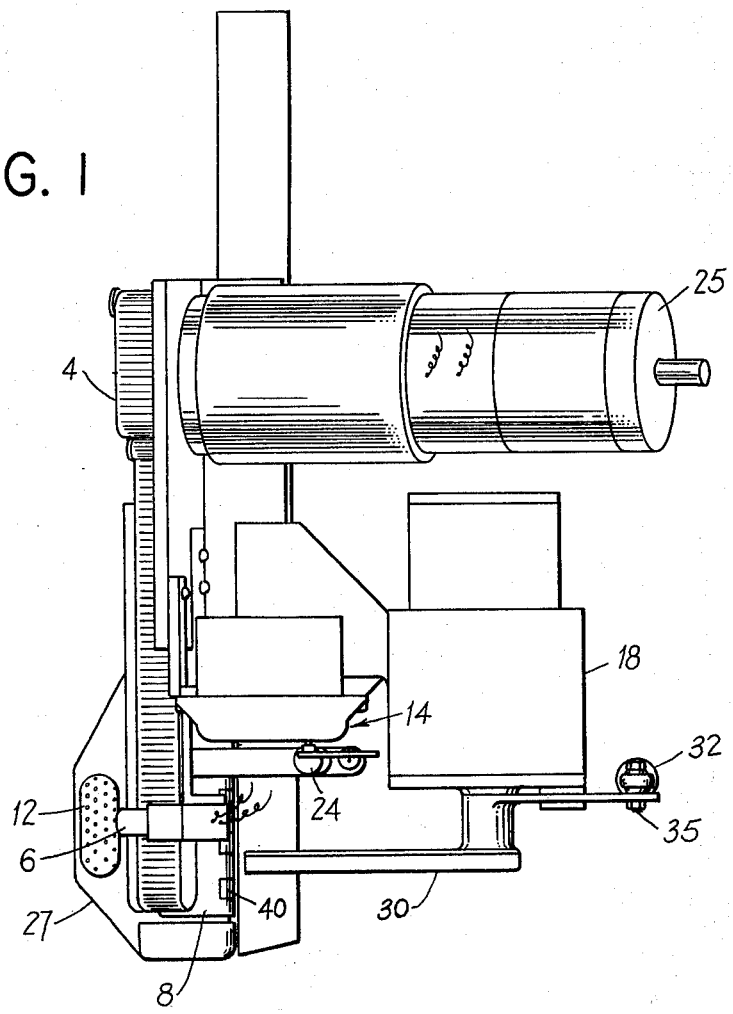
FIG. 1 is a detail top view of the inventive apparatus.
Figure 2:
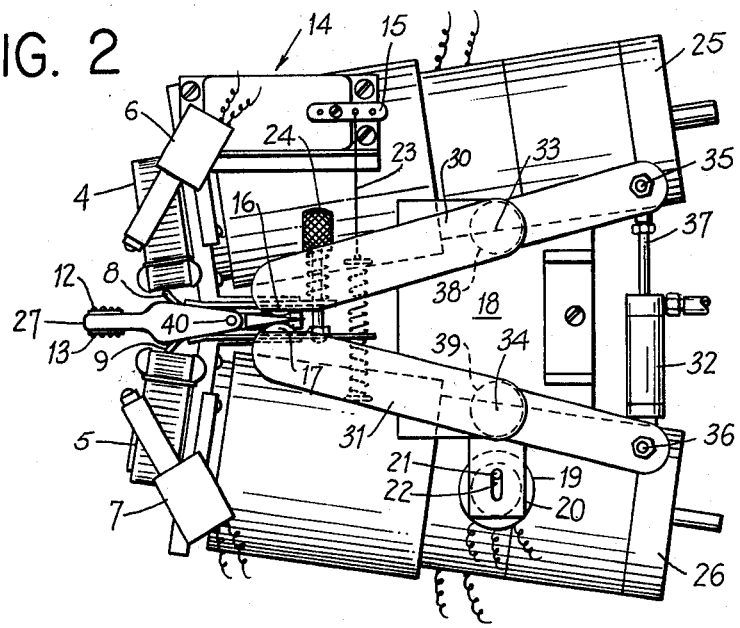
FIG. 2 is a detail profile view of FIG. 1.

As shown in FIG. 1 and 2, the pieces are inserted individually between belt 4 and plate 8 for a first piece of material and belt 5 and plate 9 for a second piece of material. Thereafter, the material pieces are caused to move individually between such belts and pressure plates in conjunction with the cooperative action of divider plate 27 and pressure plates 8, 9. The pressure plates 8, 9 are hinged to a common pivot point 40 on divider plate 27. This enables the material to smoothly proceed through the nips formed between belts 4, 5 and plates 8, 9. Because of the belt gripping action of tooth belts 4, 5, the pieces of material tend to move laterally up to a point where the photo-diode beam and associated reflective surfaces 12, 13 are interrupted by the edges of each piece of material. At this point, the dark/light bi-polar signal causes each piece of material to null on the center line of the respective photo-diodes 6, 7 and the limp material pieces are aligned with respect to each other. This procedure continues and serves to self-correct throughout the sewing cycle as the two pieces of material to be joined advance and lateral control of the edges for the entire length of seam is attained.

As is obvious to those skilled in the art, a sewing apparatus employing feed dog and presser foot feeding arrangements results in having the limp material piece which is under the feed influence of the feed dog tending to over feed while the presser foot with its inherent drag will tend to under feed. As a result, the two equal length pieces will become mis-aligned along the length of the seam to be sewn. The feed dog, usually the lower member of the feed arrangement, will cause the lower piece of material to be the shorter of the two pieces being feed and out of alignment.

To overcome the problem of mis-alignment and to maintain correct length adjustment, the invention contemplates placing a restraining force of a sufficient magnitude on the lower piece of limp material by varying the contact force of the pressure plates 8, 9. This is achieved by varying the pressure of plates 8, 9, against the respective pieces of material being shown at a point where the pieces are placed or urged against the belts 4, 5. More particularly, this is carried out by using a digital position servo-motor 14 and arm 15 linked via spring loaded bar 23 to pressure plates 8, 9. As the material to be sewn advances, rate detector wheels 16, 17 are urged to rotate by the advancing material pieces to thusly provide information to a mechanical differential computer device 18 that is operating in a subtract mode. The output of the computer device is zero when the rate detector wheels 16, 17 have an equal input to the computing device 18. As the material to be sewn becomes misaligned, the output of the computing device 18 provides signal information to the digital position servo-motor 14 and actuating arm 15 provides the necessary restraining force to correct mis-alignment.

By the present invention, as the rate detector wheels 16, 17 sense a change of synchronization of the linear rate of travel of the pieces of material to be sewn, the servo-system 19 (see FIG. 5) adjusts the presure of the pressure plates 8, 9 against the control belts 4, 5 to a magnitude sufficient to bring about proper length alignment of the pieces being sewn.

The output signal of the computer device 18 may be interfaced to the digital position servo-motor 14 by various electronic means, such as, potentioneter 19, arm 20 extends from the differential output of the computer device 18 and is connected to potentiomter 19 through a pin 21 acting through a slot 22 whereby a change in resistance of the potentioneter 19 provides the necessary signal for control of the digital position servo-motor 14.

The rate detector wheels 16, 17 are mounted on retractable arms 30, 31 which move away from divider plate 27 to permit clearance for insertion for the material to be sewn when the inventive device 1 is to be loaded in the first instance. This is accomplished through cylinder 32 which is connected to the arms 30, 31 through pivot points 35, 36 on rod 37. When the foot pedal (not shown) energizes the sewing cycle, the cylinder 32 is caused to move and urges the arms 30, 31 to move through pivot points 33, 34 through which input shafts (not shown) are connected to computer devices 18.

Differential wheels 38, 39 are connected by belts (not shown) to rate detector wheels 16, 17. Rotation of detector wheels 16, 17 causes corresponding rotation of input wheels 38, 39 providing rotational input information to computer devices 18 to which they are connected by gears or belts. Arms 30 and 31 rotate about the center line at points 33, 34 when the sewing cycle is initiated in order to urge detector wheels 16, 17 against the material separated.

The invention has been found to successfully function for sewing and/or surging. The sewing operation can employ a commercially available head in a relatively unmodified version in which the sewing system platform can be designed around a select sewing head. In the case of surging, the operational sequence is the same as that for sewing, with the exception that one ply of material is fed at a time and only one servo-driven edge and length alignment assembly is required. Obviously, the appropriate sewing head suitable for this operation would be used.

Because of the simplicity of operation and relative ease by which the material is acted upon by the inventive device, it is possible for an operator to handle successive pieces of material to be sewn, since full control over the sewing operation is transferred to the automatic features of the inventive device. As a seam is completed, the trailing edge of the material is detected by a photo-cell retro-reflective device causing the material trailing to be clamped in a position aft of the needle and presser foot arrangement to leave the sewn pieces hanging down over the rear of the machine and over an opening through which a folding blade can, if required, be positioned.

Furthermore, though forming no part of the invention, suitable thread trimming can take place immediately after the sewing operation is completed. For an example, a thread directing venturi may be constructed integral with the sewing head.

It will be apparent to those skilled in the art from the preceeding description that certain changes may be made in the above apparatus without departing from the scope of the invention. It is intended that the descriptive matter above shall be interpreted as illustrative and in no way limiting, since all equivalents within the scope of the disclosure may be substituted and such substitution is intended.

What I claim is:

1. An apparatus for aligning two plys of limp material being fed into a work station including: a pair of bi-directional motor driven belts disposed in electrical circuit relationship with closed loop servo control means; a pair of photo-diodes with light source sensing means employed in retro-reflective configuration for generation of a bi-polar signal responsive to the movement of the edges of said limp material inserted in said belts; a pair of pressure plates mounted in proximity to said belts, providing a nip therebetween for material gripping, as respective plys of material advance to said work station under the action of each of said belts, said belts being movable in response to dark/light bi-polar signals generated by the presence or absence of material at the center line of each of said photo-diodes with light source, whereby said closed loop servo control means is actuated to govern the movement of said belts with respect to any deviation from said center lines; and a pair of rate detector wheels disposed in the line of travel of said plys of materials, for rotation in response to the movement of said material; said rate detector wheels and said pressure plates being in electrical circuit relation with a digital position servo motor means to thereby adjust the relative opposing force of each of said pressure plates in response to information imparted by said rate detector wheels into a differential computer operating in subtrate mode and acting upon said servo motor means through a controller means.

2. An apparatus as claimed in claim 1 wherein: spring loaded adjusting screw means are mounted in working relation with respect to said pressure plates for controlling the gripping force on said plys of material traveling between said belts and said pressure plates.

3. An apparatus as claimed in claim 1 wherein: each of said pressure plates are pivotally mounted to a common pivot point on a support means adapted to separate each of said plys of material introduced between each of said belts and said pressure plates.

4. An apparatus as claimed in claim 1 wherein: said belts engage said respective plys of material to thereby laterally move them to a point where said photo-diode light sources and associated reflective surfaces are caused to be interrupted by the edges of said plys of material, to thusly generate a dark/light bi-polar signal causing said belts to advance said material to null on the center line of each of said respective photo-diodes.

5. An alignment apparatus in combination with a sewing machine station having a pressure foot and cooperative feed dogs for advancing an upper ply and a lower ply of material into sewing means for sewing said plys together, said alignment apparatus being forward of and disposed along the line of travel of said material plys for urging respective edge portions and lengths of said material plys into alignment with respect to one another, including: upper and lower motor driven rotatable gripping belts mounted on a support means for movement of each of said material plys above and below said support means; said support means being defined by a member having converging surfaces for separating said upper and lower plys of material as they advance; upper and lower material gripping means pivotally mounted in proximity to said gripping belts, provided with material contact surfaces to thereby form a nip with each of said upper and lower belt means; upper and lower sensing means each being positioned in working relation to said upper and lower gripping belts, each of said sensing means being adapted to sense the absence or presence of respective plys of material at the center line thereof; control means in circuit relation with each of said sensing means and said belt means, for continuously governing the movement of each of said belts, responsive to signals imparted by the respective position of each of said plys of material; upper and lower rotary sensing means being pivotally mounted in support arms for position along the line of travel of said material plys, said rotary sensing means providing a signal means responsive to the longitudinal movement between each of said plys of material; passage means formed between a forward portion of said support means and each of said rotary sensing means for movement of material therethrough; and control means responsive to signal means imparted through the impingement of said rotary sensing means on said material, for restraining forward movement of said material plys in respect to each other, as a function of the relative restraining force of said upper and lower material gripping means.

6. An apparatus as claimed in claim 5, wherein: length adjustment of upper and lower plys of material traveling to said sewing machine station includes, restraining means for varying the relative contact force of said upper and lower material gripping means with respect to the upper and lower plys of material being worked upon.

7. An apparatus as claimed in claim 1 wherein: said differential computer is at zero output when each of said rate detector wheels have equal input to said differential computer.

8. An apparatus as claimed in claim 5 wherein: rotary sensing means are provided to sense synchronization of the linear rate of travel of said respective material plys and said control means being provided to adjust said upper and lower material gripping means with respect to said gripping belts.

9. An apparatus as claimed in claim 1, wherein: said differential computer device is connected to said servo motor through potentioneter means acting in response to a computer output means.

* * * * *